United States Patent [19]

Leupold

[11] Patent Number: 4,861,752

[45] Date of Patent: Aug. 29, 1989

[54] HIGH-FIELD PERMANENT-MAGNET STRUCTURES

[75] Inventor: Herbert A. Leupold, Eatontown, N.J.

[73] Assignee: The United States of America as represented by the Secretary of the Army, Washington, D.C.

[21] Appl. No.: 199,501

[22] Filed: May 27, 1988

[51] Int. Cl.[4] ..... H01F 7/02; H01F 7/22

[52] U.S. Cl. ..... 505/1; 335/216; 335/306; 315/535

[58] Field of Search ..... 335/216, 302, 304, 306, 335/212; 505/1; 315/5.24, 5.34, 5.35

[56] References Cited

U.S. PATENT DOCUMENTS

| | | | |
|---|---|---|---|
| 2,952,803 | 9/1960 | Charles et al. | 335/302 |
| 3,768,054 | 10/1973 | Neugebauer | 335/306 X |
| 4,392,078 | 7/1983 | Noble et al. | 315/5.35 X |
| 4,429,229 | 1/1984 | Gluckstern | 335/212 X |
| 4,614,930 | 9/1986 | Hickey et al. | 335/306 X |

OTHER PUBLICATIONS

"Proceedings of the Eighth International Workshop on Rare Cobalt Permanent Magnets", by Klaus Halbach (Univ. Dayton, Dayton OH, 1985), pp. 123–136.

*Primary Examiner*—George Harris

*Attorney, Agent, or Firm*—Sheldon Kanars; John K. Mullarney

[57] ABSTRACT

An azimuthally circumscribed section of a hollow hemispherical magnetic flux source (i.e., a quarter-spherical or one eighth-spherical structure) has a superconducting planar sheet abutting one flat face of the section and, at least, a second planar sheet of selected material (e.g., paramagnetic or diamagnetic) abutting another flat face of the section and perpendicular to the first sheet. The magnetic "mirror" image of the magnetic section in the diamagnetic (superconductor) plane and the virtual (anti-mirror and/or mirror) image(s) in the other perpendicular plane(s) makes the central cavity appear (magnetically) exactly as if a complete "magic sphere" were its source. The central or working cavity is readily accessible through a hole in the first or second planar sheet.

21 Claims, 3 Drawing Sheets

HIGH-FIELD PERMANENT-MAGNET STRUCTURES

The invention described herein may be manufactured, used and licensed by or for the Government for governmental purposes without the payment to me of any royalties thereon.

TECHNICAL FIELD

The present invention relates in general to permanent-magnet structures for use in electronic devices and, more particularly, to hollow quarter-spherical and one eighth-spherical magnetic flux sources which produces uniform magnetic fields greater than the remanence of the magnetic material comprising them.

BACKGROUND OF THE INVENTION

Many devices that employ magnetic fields have heretofore been encumbered by massive solenoids with their equally bulky power supplies. Thus, there has been increasing interest in the application of permanent-magnet structures for such uses as electron-beam focusing and biasing fields. The current demand for compact, strong, static magnetic field sources that require no electric power supplies has created needs for permanent magnet structures of unusual form. A number of configurations have been designed and developed for electron-beam guidance in mm/microwave tubes of various types; for dc biasing fields in millimeter wave filters, circulators, isolators, strip-lines; for field sources in NMR (nuclear magnetic resonance) imagers; and so on. Especially promising for such purposes is the configuration based on the hollow cylindrical flux source (HCFS) principle described by K. Halbach, in "Proceedings of the Eighth International Workshop on Rare Earth Cobalt Permanent Magnets" (University of Dayton, Dayton, Ohio, 1985) pp. 123–136. A HCFS, sometimes called a "magic ring," is a cylindrical permanent-magnet shell which offers a magnetization vector that is more-or-less constant in magnitude and produces a field greater than the remanence of the magnetic material from which it is made.

The "magic ring" or HCFS concept has proven to be useful for a variety of applications that require relatively high transverse fields in tubular working spaces (e.g., mm/microwave radiation sources and amplifiers). Unfortunately, there are field distortions in the magic ring due to end effects, and to achieve a fairly uniform biasing field the device would have to be wastefully long (i.e., a very large length-to-radius ratio). And, the length necessary to achieve a highly uniform biasing field requires a fairly massive structure.

In the co-pending patent application of the present inventor, Ser. No. 199,500, filed 5/27/88, there is disclosed a hollow spherical flux source(s) which achieves a strong, uniform biasing field within a very compact structure. Also, the uniform high-field is undistorted and greater than that produced by a magic ring of the same radius. Since it is not feasible to construct an ideal hollow spherical flux source (HSFS) or "magic sphere," in practice a segmented approximation is utilized.

In another co-pending patent application of the present inventor, Ser. No. 199,504, filed 5/27/88, there is disclosed a hollow hemispherical flux source (HHFS) or "magic igloo" which comprises half a magic sphere placed on a planar sheet of high saturation, high permeability material. The magnetic "anti-mirror" image of the hemispheric structure in the permeable plane makes the hemispheric central cavity appear (magnetically) exactly as if a complete magic sphere were its source. Since it is similarly not feasible to construct an ideal hollow hemispherical flux source, in practice a segmented approximation is utilized. And, a segmented hemisphere is of course easier and cheaper to make than a segmented sphere.

SUMMARY OF THE INVENTION

In accordance with the present invention, an azimuthally circumscribed section of a hollow hemispherical magnetic flux source (i.e., a quarter-spherical or one-eighth spherical structure) has a superconducting planar sheet abutting one flat face of the section and, at least, a second planar sheet of selected material (e.g., paramagnetic or diamagnetic) abutting another flat face of the section and perpendicular to the first sheet. The magnetic "mirror" image of the magnetic section in the diamagnetic (superconductor) plane and the virtual (anti-mirror and/or mirror) images(s) in the other perpendicular plane(s) makes the central cavity appear (magnetically) exactly as if a complete "magic sphere" were its source. The central or working cavity is readily accessed through a hole in the first or second planar sheet.

In an embodiment of the invention, a hollow quarter-spherical magnetic flux source is placed at its equator upon a planar sheet of high saturation, high permeability material. A superconducting planar sheet abuts the other flat face of the quarter-sphere at right angles to the permeable sheet. The magnetic "anti-mirror" image of the quarter-spherical structure in the permeable plane and the magnetic "mirror" image of the quarter-spherical structure in the diamagnetic (superconductor) plane makes the quarter- spherical central cavity appear (magnetically) exactly as if a complete magic sphere were its source.

In another embodiment of the invention a hollow quarter-spherical magnetic flux source abuts a superconducting sheet along one longitudinal meridian and a second superconducting sheet along a second longitudinal meridian ninety degrees removed from the first meridian. The magnetic "mirror" images of the quarter-spherical structure in the diamagnetic (superconductor) planes make the quarter-spherical central cavity appear (magnetically) exactly as if a complete magic sphere were its source.

In still another embodiment of the invention, a hollow one eighth-spherical magnetic flux source is placed at its equator upon a planar sheet of high saturation, high permeability material. A superconducting sheet abuts the eighth-spherical structure along a longitudinal meridian and a second superconducting sheet abuts the eighth-spherical structure along a second longitudinal meridian ninety degrees removed from the first meridian. The magnetic "anti-mirror" image of the eighth-spherical structure in the permeable plane and the magnetic "mirror" images of the eighth- spherical structure in the diamagnetic planes makes the eighth- spherical central cavity appear (magnetically) exactly as if a complete magic sphere were its source.

BRIEF DESCRIPTION OF THE DRAWINGS

The invention will be more fully appreciated from the following detailed description when the same is considered in connection with the accompanying drawings in which.

DETAILED DESCRIPTION OF THE DRAWINGS

Figure 1:
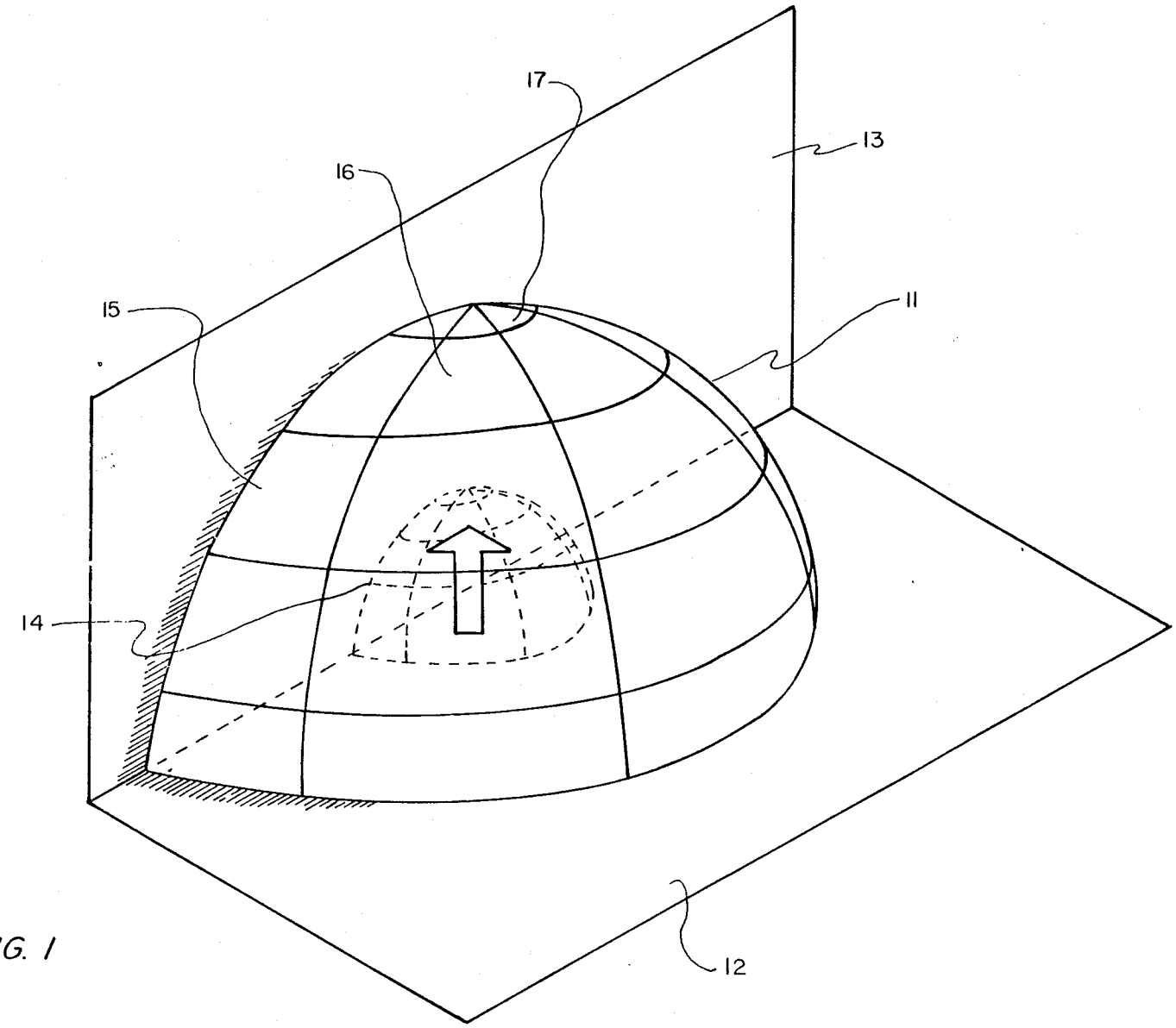
FIG. 1 shows a hollow quarter-spherical magnetic flux source in accordance with the invention.

FIG. 1 illustrates a hollow quarter-spherical flux source 11 in accordance with the invention. The flux source 11 is, of course, half of a hemisphere or, more specifically, half of the hollow hemispherical magnetic flux source (HHFS) or magic igloo disclosed in the above-noted co-pending application. The flux source 11 is placed at its equator or equitorial plane upon a planar sheet 12 of high saturation, high permeability material (e.g., one of the soft ferromagnets). A planar sheet 13 of superconducting material abuts the other flat face of the quarter-spherical structure 11 at right angles to the permeable sheet 12. The hollow quarter-spherical structure is composed of magnetic material and its magnetization is azimuthally symmetrical. The large arrow in FIG. 1 designates the uniform high-field in the central cavity, the latter being a quarter-spherical hole. The magnetic "anti-mirror" image of the quarter-spherical structure in the permeable plane and the magnetic "mirror" image of the quarter-spherical structure in the diamagnetic (superconductor) plane makes the quarter-spherical central cavity 14 appear (magnetically) exactly as if a complete magic sphere were its source. Therefore, a substantially uniform, high magnetic field is provided in the cavity 14. The term "magnetic anti-mirror" means a magnetic "mirror" that reverses or inverts the magnetic image. Stated somewhat differently, a magnetic anti-mirror forms a virtual inverted magnetic image of a given pole distribution. In contrast, a "magnetic mirror" means a "mirror" that does not reverse or invert the magnetic image. The sheet 12 of permeable material and sheet 13 of superconducting material are magnetically passive (i.e., neither has a permanent magnetic moment). While a superconducting (diamagnetic) sheet is perfect diamagnetic material ($B=0$) will suffice, even if the same specified, it will be understood by those in the art that any is not superconducting.

The field (H) in the quarter-spherical central cavity 14 is essentially the same as the high-field in the central cavity of a hollow spherical flux source, namely:

$H=(4/3)B_r \ln(v_o/v_i)$ where $B_r$ is the remanence of the magnetic material and $v_o$ and $v_i$ are, respectively the outer and inner radii of the quarter-sphere.

Also, as in the case of the magic sphere and magic igloo described in the above-noted co-pending applications, the magnetization orientation ($\alpha$) in the quarter-spherical permanent magnet shell 11 is substantially equal to twice the polar angle ($\theta$);$\alpha=2\theta$. The value $\alpha$ is the magnetization angle with respect to the polar axis.

Ideally, the quarter-spherical structure 11 should be composed of a single, unitary piece of magnetic material. However, since it is not feasible to construct such an ideal structure, in practice a segmented approximation such as that shown in FIG. 1 is used. This segmenting of the FIG. 1 structure corresponds to the segmented approximation(s) disclosed in my co-pending patent applications. Each of the segments, e.g., 15–17, extends in a tapered fashion from the central cavity 14 to the outer surface of the quarter-spherical structure. In such a configuration the magnetization is constant in both amplitude and direction within any one segment. Fortunately, even with as few as four segments per half circle of longitude, more than 90 percent of the field of an ideal structure is obtainable. This greatly facilitates construction of a practical device and reduces costs considerably. Azimuthal field dependence is assumed to be continuous. The number of segments that comprise a quarter-spherical structure is more-or-less arbitrary; however, the greater the number of segments the closer the approximation to the ideal case.

For the field in the central cavity to be useful, accessibility to electrical leads and/or other conduits is necessary. To this end, a hole can be drilled through the permeable plate 12 or superconducting plate 13 without marring the expensive magnetic structure. Given just a hole through the plate 12, for example, the structure of FIG. 1 can be used to conduct a laboratory experiment in which one could measure the Hall effect of a semiconductor material disposed in the quarter-spherical cavity; the hole provides the access for electrical leads. Other and different uses will occur to those skilled in the art. For other applications (e.g., traveling wave tubes) a tunnel through the quarter-spherical magnetic shell is also necessary. The tunnel would, of course, be aligned with the hole in plate 12.

Figure 2:
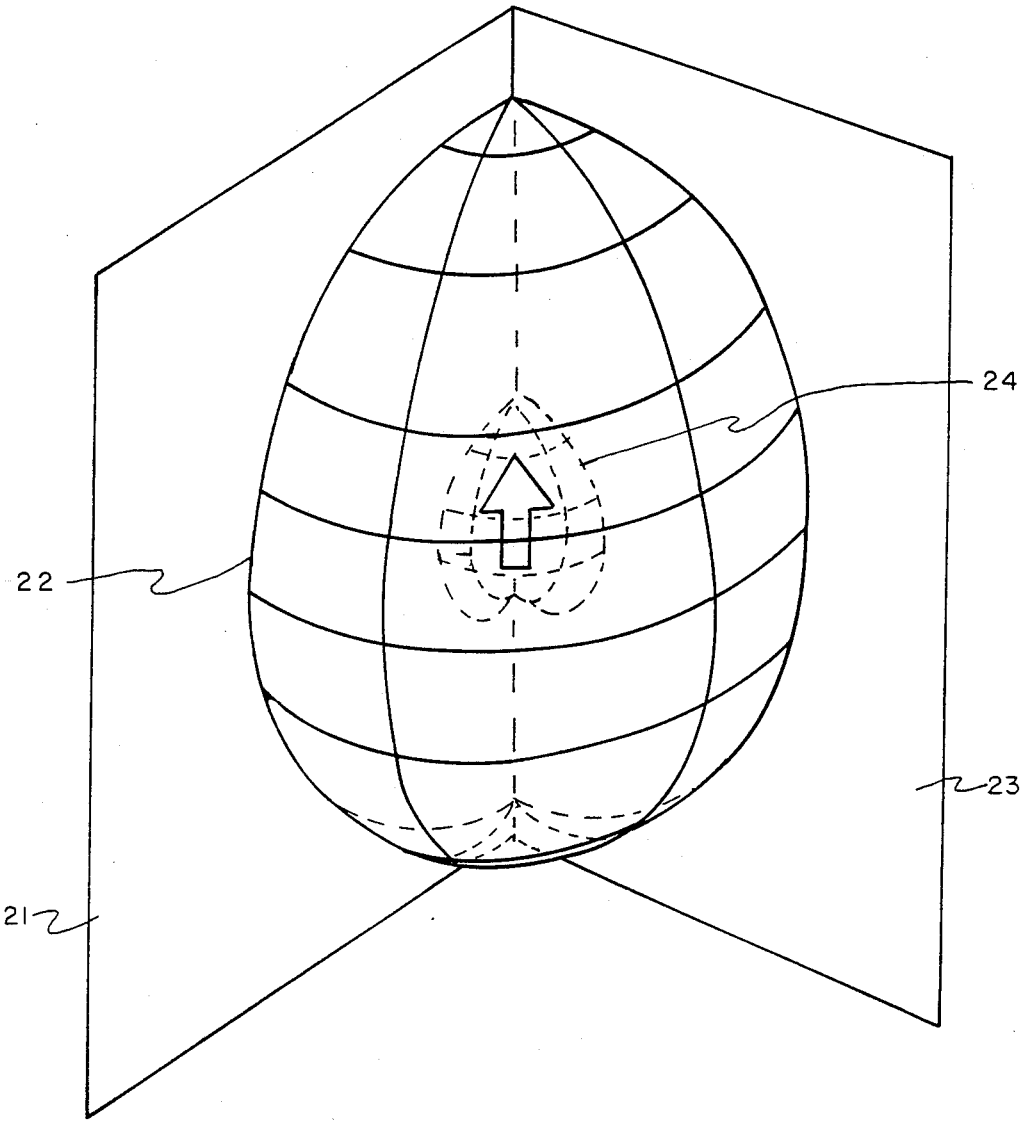
FIG. 2 shows a second inventive embodiment of a hollow quarter-spherical magnetic flux source; and, FIG. 3 shows a one eighth-spherical flux source in further accordance with the principles of the present invention.

FIG. 2 illustrates another embodiment of the present invention. A superconducting sheet 21 abuts the hollow quarter-spherical magnetic flux source 22 along one longitudinal meridian and a second superconducting sheet 23 abuts the quarter-spherical structure 22 along a second longitudinal meridian ninety degrees removed from the first meridian. The segmented quarter-spherical structure of FIG. 2 is much the same as that of FIG. 1 except that it is "cut" or "sliced" to abut the pair of diamagnetic "imaging" plates 21,23 along a pair of longitudinal meridians 90° apart. The magnetic "mirror" images of the quarter-spherical structure 22 in the diamagnetic (superconductor) planes makes the quarter-spherical central cavity 24 appear (magnetically) exactly as if a complete magic sphere were its source. Thus, a substantially uniform, high magnetic field is provided in the quarter-spherical cavity 24, as indicated by the large arrow.

Figure 3:
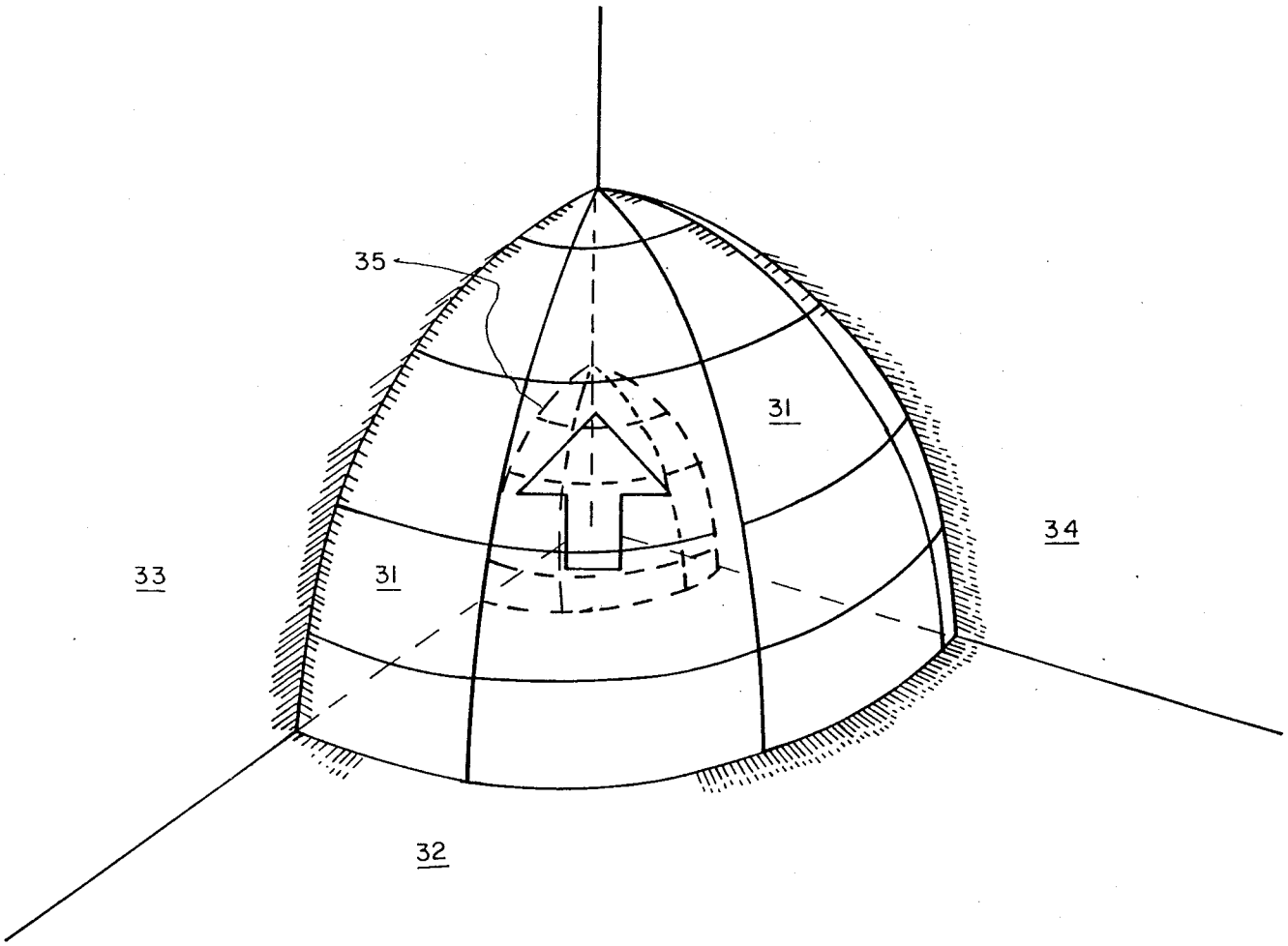

The embodiment illustrated in FIG. 3 of the drawings can be considered a combination of the embodiments of FIG. 1 and 2. As will be evident in the drawing, the magnetic flux source 31 is a hollow one eighth-spherical structure which is segmented in the manner previously described. The eighth-spherical structure is placed at its equator upon a planar sheet 32 of high saturation, high permeability material. A superconducting sheet 33 abuts the eighth-spherical structure 31 along a longitudinal meridian and a second superconducting sheet 34 abuts the eighth-spherical structure 31 along a second longitudinal meridian ninety degrees removed from the first meridian. The superconducting sheets 33 and 34 are, of course, perpendicular to the permeable sheet 32. The magnetic "anti-mirror" image of the eighth-spherical structure in the permeable plane and the magnetic "mirror" images of the eighth-spherical structure in the diamagnetic planes make the eighth-spherical central cavity 35 appear (magnetically) exactly as if a complete magic sphere were its source. The large arrow in FIG. 3 indicates the high-field in the central cavity which is accessible by means of a hole in the permeable plate 32 or in either or both of the superconductor plates 33, 34. For some applications such as traveling wave tubes a tunnel through the one eighth-spherical magnetic shell is also necessary. The tunnel would be aligned with a hole in the plate 32.

If a segmented magic sphere requires a minimum of say 64 segments to reasonably approximate an ideal magic sphere, the embodiment shown in FIG. 3 would require only 8 segments to achieve an equivalent field. To obtain the same working volume as in the magic sphere an enlarged eighth-spherical structure can be employed. Since these structures are very small for the fields produced in any case, the additional material used by an enlarged eighth-sphere over the smaller full sphere would, in most cases, be more than offset by the enhanced ease of manufacture and simplicity of construction.

The magnetic material of the segments of the quarter-sphere and eighth-sphere flux sources may be composed of $$Nd_2Fe_{14}B,\ SmCo_5,\ PtCo_5,\ Sm_a(Co,\ T)_{17}$$

where T is one of the transition metals, and so on. The foregoing materials are characterized by the fact that they maintain their full magnetization to fields larger than their coercivities. These and other equivalent magnetic materials (e.g., selected ferrites) are known to those in the art. Accordingly, it is to be understood that the principles of the present invention are in no way limited to the magnetic material selected for the segments. Also, as known to those skilled in the art, the segments can be pressed to the appropriate shape(s) and magnetized in the desired orientation using any of the known magnetization techniques. Standard machining techniques can also be utilized to make the segments.

The high saturation, high permeability planar sheet (e.g., numerals 12/32) may be comprised of iron, permandur, permalloy, etc. As is known to those skilled in the art, the plate must be thick enough to prevent saturation of the plate material. Stated somewhat differently, the flux in the cavity must not exceed an amount that will result in a value of B (flux density) in the anti-mirror material that is greater than its saturation value. Thus, there is an interrelationship between the desired cavity field and the plate thickness. For a field of about 20 kOe a plate of iron should be at least 1 cm in thickness; for permandur a plate thickness of about 0.8 cm will suffice.

The plates or planar sheets 13, 21, 23, 33 and 34 can, in bulk form, be composed of tin, lead, niobium, tantalum, etc. Each of these materials, and others, are known to be superconducting below a distinct critical temperature. Moreover, recent developments in the field of superconductivity have produced a large variety of new ceramic-type materials which are capable of achieving the superconducting state at critical temperatures above 77° K., the boiling point of liquid nitrogen. By way of example, an entire class of superconducting compounds with the chemical composition $RBa_2Cu_3O_{9-y}$ (where R stands for a transition metal or a rare earth ion and y is a number less than 9, preferably $2.1\pm0.05$) has demonstrated superconductive properties above 90° K. The superconducting ceramics are formed by plasma-spraying techniques, or sputtered or evaporated onto a substrate (magnesium oxide), or produced by growing epitaxial films ($RBa_2Cu_3O_{7-x}$) on a substrate (e.g., $SrTiO_3$), etc. It is to be understood, however, that the present invention is in no way limited to the superconducting material selected for the superconductor planar sheets or, if the same is a superconductive-ceramic, the manner in which the same is formed.

As will be evident to those skilled in the art, the high-field in the central cavity must not be greater than the lower critical field (Hcl) of the superconductor(s). This, of course, presents no significant restriction.

The thickness of the superconductor plates 13, 21, 23 etc. must be greater than the magnetic penetration depth. Here again, however, this presents no significant limitation. If a superconducting ceramic is used, a superconductor sheet thickness of at least 50 nanometers is desirable.

There are various techniques known to those skilled in the art for bringing (i.e., cooling) the superconductor plate material to its distinct critical temperature. Since the same comprises no part of the present invention and one or more of these known techniques will suffice for present purposes, further detailed discussion herein would not appear to be necessary.

It is, of course, a good deal easier and cheaper to make a quarter, or one-eighth, of magic sphere than a whole one, or even half a whole one (i.e., a magic igloo). The structures of the present invention require fewer segments, considerably less fabrication (e.g., machining), and less risk of flaws. Also, if only a single access hole is required, it can be drilled through a readily replaceable (iron) plate or a superconductor plate rather than through the somewhat brittle and expensive magnetic shell.

Having shown and described what is at present considered to be several preferred embodiments of the invention, it should be understood that the same has been shown by way of illustration and not limitation. And, all modifications, alterations and changes coming within the spirit and scope of the invention are meant to be included herein.

What is claimed is:

1. A permanent magnet structure comprising an azimuthally circumscribed section of a hollow hemispherical magnetic flux source, the magnetic orientation in said section with respect to the polar axis being substantially equal to twice the polar angle, a superconducting planar sheet abutting one flat face of said section along a longitudinal meridian, and at least one other planar sheet of selected material abutting another flat face of said section and perpendicular to the first-mentioned sheet.

2. A permanent magnet structure comprising a hollow quarter-spherical magnetic flux source, the magnetic orientation in said flus source with respect to the polar axis being substantially equal to twice the polar angle, a planar plate of high saturation high permeability material abutting the quarter-spherical structure at its equator, and a planar plate of superconducting material abutting the other flat face of the quarter-sphere and at right angles to the permeable plate.

3. A permanent magnet structure as defined in claim 2 wherein the central cavity of the hollow quarter-spherical structure is substantially quarter-spherical.

4. A permanent magnet structure as defined in claim 3 wherein said permeable plate has an access hole therethrough.

5. A permanent magnet structure as defined in claim 4 wherein the hollow quarter-spherical structure is comprised of a plurality of segments which extend in a tapered manner from the quarter-spherical central cavity to the outer surface of the quarter-spherical structure.

6. A permanent magnet structure as defined in claim 5 wherein the field (H) in said central cavity is given by:

$$H=(4/3)B_r\ln(v_o/v_i)$$

where $B_r$ is the remanence of the magnetic material and $v_o$ and $v_i$ are, respectively, the outer and inner radii of the quarter-spherical structure.

7. A permanent magnet structure as defined in claim 6 wherein said permeable plate is comprised of a selected soft ferromagnetic material.

8. A permanent magnet structure as defined in claim 7 wherein said planar plate of superconducting material is comprised of a superconducting ceramic material.

9. A permanent magnet structure comprising a hollow quarter-spherical magnetic flux source, the magnetic orientation in said flux source with respect to the polar axis being substantially equal to twice the polar angle, a planar plate of superconducting material abutting the quarter-sphere along a longitudinal meridian, and a second planar plate of superconducting material abutting the quarter-sphere along a second longitudinal meridian ninety degrees removed from the first meridian.

10. A permanent magnet structure as defined in claim 9 wherein the central cavity of the hollow quarter-spherical structure is substantially quarter-spherical.

11. A permanent magnet structure as defined in claim 10 wherein one of said planar plates has an access hole therethrough.

12. A permanent magnet structure as defined in claim 11 wherein the hollow quarter-spherical structure is comprised of a plurality of segments which extend in a tapered manner from the quarter-spherical central cavity to the outer surface of the quarter-spherical structure.

13. A permanent magnet structure as defined in claim 12 wherein the field (H) in said central cavity is given by:

$$H=(4/3)\ B_r\ln(v_o/v_i)$$

where $B_r$ is the remanence of the magnetic material $v_o$ and $v_i$ are, respectively, the outer and inner radii of the hemisphere.

14. A permanent magnet structure as defined in claim 13 wherein said planar plates of superconducting material are comprised of a superconducting ceramic material.

15. A permanent magnet structure comprising a hollow one eighth-spherical magnetic flux source, the magnetic orientation in said flux source with respect to the polar axis being substantially equal to twice the polar angle, a planar plate of high saturation high permeability material abutting the eighth-spherical structure at its equatorial plane, a planar plate of superconducting material abutting the eighth-spherical structure along a longitudinal meridian, and a second planar plate of superconducting material abutting the eighth-spherical structure along a second longitudinal meridian ninety degrees removed from the first meridian.

16. A permanent magnet structure as defined in claim 15 wherein the central cavity of the hollow one eighth-spherical structure is substantially one eighth-spherical.

17. A permanent magnet structure as defined in claim 16 wherein one of said planar plates has an access hole therethrough.

18. A permanent magnet structure as defined in claim 17 wherein the hollow eighth-spherical structure is comprised of a plurality of segments which extend in a tapered manner from the central cavity to the outer surface of the eighth-spherical structure.

19. A permanent magnet structure as defined in claim 18 wherein the field (H) in said central cavity is given by:

$$H=(4/3)B_r\ln(v_o/v_i)$$

where $B_r$ is the remanence of the magnetic material and $v_o$ and $v_i$ are, respectively, the outer and inner radii of the eighth-spherical structure.

20. A permanent magnet structure as defined in claim 19 wherein said permeable plate is comprised of a selected soft ferromagnetic material.

21. A permanent magnet structure as defined in claim 20 wherein said planar plates of superconducting material are comprised of a superconducting ceramic material.

* * * * *